US005095599A

United States Patent [19]

Gloe et al.

[11] Patent Number: 5,095,599

[45] Date of Patent: Mar. 17, 1992

[54] ELECTRICAL TERMINAL APPLICATOR AND A CRIMP HEIGHT ADJUSTMENT PLATE THEREFOR

[75] Inventors: Karl-Heinz Gloe, Reichelsheim; Michael Gerst, Worms; Helmuth Kreuzer, Munster, all of Fed. Rep. of Germany

[73] Assignee: AMP Incorporated, Harrisburg, Pa.

[21] Appl. No.: 706,914

[22] Filed: May 29, 1991

[30] Foreign Application Priority Data

May 30, 1990 [GB] United Kingdom ..... 9012073

[51] Int. Cl.[5] ..... H01R 43/04; B21J 13/00

[52] U.S. Cl. ..... 29/33 M; 29/753; 72/441

[58] Field of Search ..... 29/33 M, 748, 747, 753, 29/761, 566, 566.1, 566.3; 72/441, 446

[56] References Cited

U.S. PATENT DOCUMENTS

| | | | |
|---|---|---|---|
| 3,859,708 | 1/1975 | Keim et al. | 29/747 X |
| 3,867,754 | 2/1975 | Koch | 29/753 X |
| 3,911,717 | 10/1975 | Yuda | 29/566.3 X |
| 3,962,780 | 6/1976 | Kindig | 72/441 X |
| 4,019,362 | 4/1977 | McKeever | 29/753 X |
| 4,025,999 | 5/1977 | Wolyn et al. | 29/753 |
| 4,400,873 | 8/1983 | Kindig et al. | 72/441 X |
| 4,581,796 | 4/1986 | Fukuda et al. | 29/33 M |
| 4,587,725 | 5/1986 | Ogawa et al. | 29/753 |
| 4,667,398 | 5/1987 | Leiby | 29/566.3 X |
| 4,790,173 | 12/1988 | Boutcher, Jr. | 72/446 |
| 4,856,186 | 8/1989 | Yeomans | 29/748 X |
| 4,970,889 | 11/1990 | Phillips | 72/446 |

FOREIGN PATENT DOCUMENTS

| | | | |
|---|---|---|---|
| 279036 | 8/1988 | European Pat. Off. | 29/753 |
| 1315501 | 5/1973 | United Kingdom | 29/753 |

*Primary Examiner*—William Briggs
*Attorney, Agent, or Firm*—Bruce J. Wolstoncroft; Thomas G. Terrell

[57] ABSTRACT

An applicator ram (8) driven by a press ram (46) drives an insulation barrel crimping die (10) which is adjustable lengthwise of the rams (8) and a wire barrel crimping die (14) fixed to the applicator ram (8), to crimp electrical terminals (T) to leads (L) in cooperation with an anvil (22). A crimp height adjustment disc (60) is rotatable about a shaft (104) on the applicator ram (8) selectively to interpose first projections (76) on one side of the disc (60) between the press ram (46) and the applicator ram (8) to adjust the shut height of the wire barrel crimping die (14) and selectively to interpose second projections (82) on the other side of the disc (60) between the applicator ram (8) and the insulation barrel crimping die (10) to adjust its shut height. The projections (76 and 82) are so dimensioned and arranged and are provided in such relative numbers that for each different shut height of the wire barrel crimping die (14) a plurality of different shut heights, for the insulation barrel crimping die (10) can be selected by suitably angularly adjusting the disc (60).

10 Claims, 3 Drawing Sheets

10
12
14
58
54
52
48
L
I
C
T'
WB
IB
22
26
24
CC
ST
S
4
16
20
18
34
T
50
56
3

64
62
65
63
68
72
70
76A
76B
76C
76D
76E
76F
76G
76H
77
78
79
80
82
84
86
88
90
H1'
H2'
H3'
H4'
H1
H2
H3
H4
H5
H6
H7
H8
H9
H10
H11
H12
H13
H14
H15
H16
W1
W2
W3
W4

ELECTRICAL TERMINAL APPLICATOR AND A CRIMP HEIGHT ADJUSTMENT PLATE THEREFOR

FIELD OF THE INVENTION

This invention relates to an electrical terminal applicator and to a crimp height adjustment plate therefor.

BACKGROUND OF THE INVENTION

There is disclosed in U.S. application Ser. No. 3,184,950 an electrical terminal applicator comprising an applicator ram drivable by means of a press ram through a working stroke towards, and a return stroke away from, a crimping anvil, the applicator ram having thereon a first crimping die for cooperation with the anvil to crimp a wire barrel of an electrical terminal to a bared end portion of the metal core of an insulated electrical lead during each working stroke of the applicator ram, and a second crimping die for crimping an insulation barrel of the terminal to the insulation of the lead during said working stroke, and being adjustable lengthwise of the applicator ram, plate means being mounted for angular adjustment about an axis on, and extending lengthwise of, the applicator ram, selectively to interpose first projections between the press ram and the applicator ram to adjust the shut height of the first die and selectively to interpose second projections between the applicator ram and the second crimping die to adjust the shut height of that die.

In the case of this known applicator, the said plate means comprises two calibrated discs which are independently angularly adjustable manually about said axis, one of the plates carrying the projections for adjusting the shut height of the first die and the other die carrying the projections for adjusting the shut height of the second die. The two discs are provided because for each position of adjustment of the first die there must be a plurality of positions of adjustment of the second die as explained in detail below.

SUMMARY OF THE INVENTION

The present invention is intended to avoid the disadvantage that the shut heights, that is to say the crimp heights of the two dies must be separately adjusted.

According to one aspect of the invention an applicator as defined in the second paragraph of this specification is characterized in that said plate means is in the form of a single unit, the first projections being disposed on one side thereof and the second projections being disposed on the opposite side thereof, the number of the second projections being a multiple of the number of the first projections and the maximum width of each first projection, about said axis being a multiple of the maximum width of each second projection about said axis.

Thus for each shut height position of adjustment of the first die the single unit plate means can have a plurality of positions of angular adjustment about its axis, in each of which angular positions a different second projection is interposed between the applicator ram and the second die. This is of particular advantage when the crimp heights of the dies are to be set by servo means acting upon the single unit plate means under the control of a switch panel or of a computer controlling a series of applicators and associated equipment for feeding electrical leads thereto, since the crimp height of both of the dies can be set through the agency of a single control signal from the switch panel or from the computer, and only a single servo motor needing to be provided.

The first projections may, for example, be eight in number, the second projections being sixteen in number, the maximum width of each first projection being twice the maximum width of each second projection about the axis of rotation of the single unit plate means, the first projections being arranged in pairs of projections of equal height and the projections of each pair being located at diametrically opposed positions with respect to the axis of rotation of the single unit plate means. In this case for each different crimp height of the wire barrel crimping die, four different crimp heights for the insulation crimping die are provided for.

According to another aspect of the invention a crimp height adjustment plate for an electrical terminal applicator comprises a central bore for receiving a shaft for mounting the adjustment plate for rotation about the axis of the shaft, a ring of flat topped first projections evenly distributed about the central bore upon one major surface of the plate and the flat tops of the projections being of selected heights above said major surface; is characterized by a ring of second flat topped projections evenly distributed about said central bore on the opposite major surface of the adjustment plate and being of selected heights above said opposite major surface; and in that the maximum width of the flat top of each first projection, about the central bore is a multiple of the maximum width of the flat top of each second projection about the central bore, the number of said second projections being a multiple of the number of said first projections.

BRIEF DESCRIPTION OF THE DRAWINGS

An embodiment of the present invention will now be described by way of example with reference to the accompanying drawings in which.

DETAILED DESCRIPTION OF THE INVENTION

Figure 1:
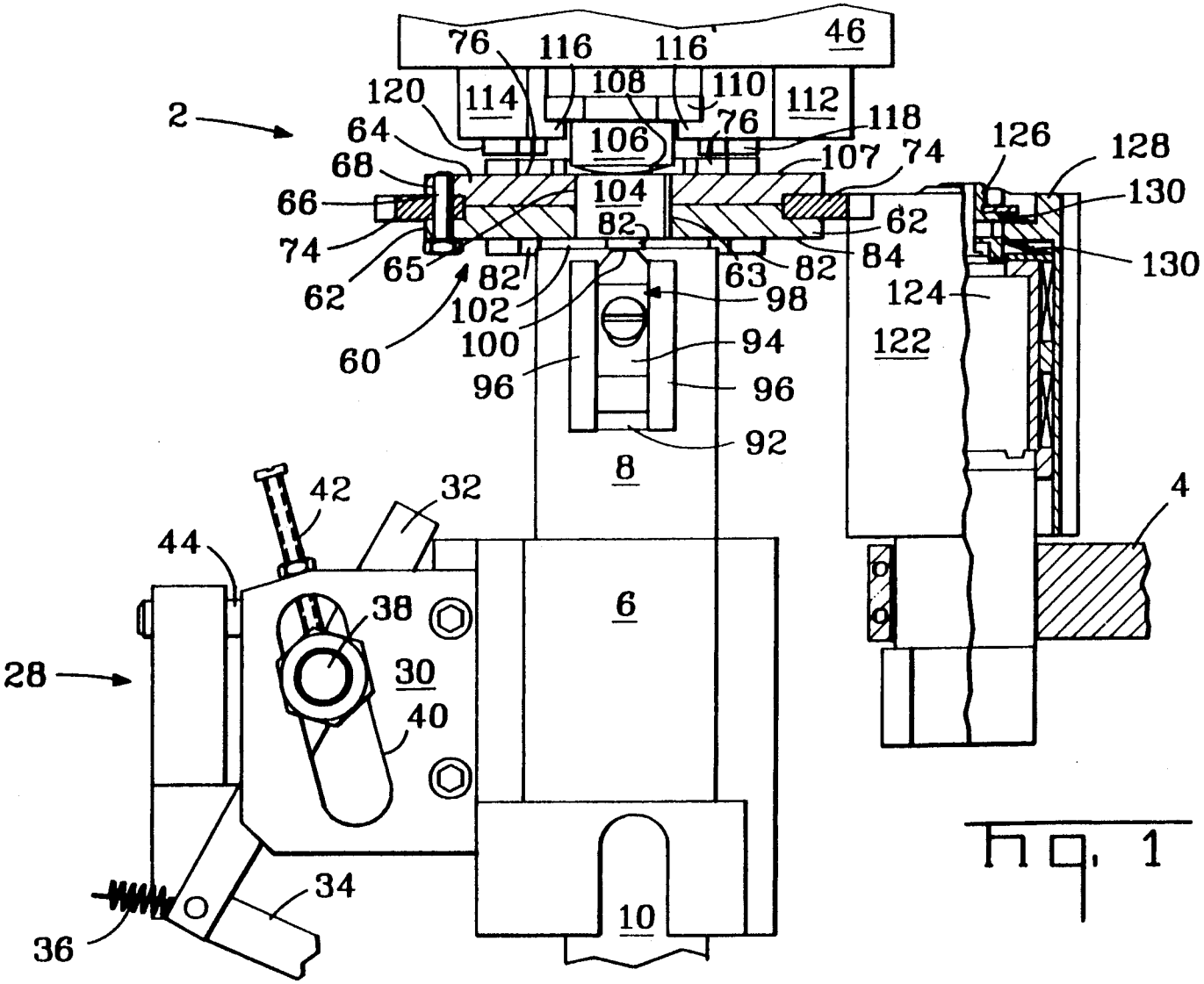
FIG. 1 is a fragmentary front view, shown partly in section of an applicator for crimping electrical terminals to stripped end portions of insulated electrical leads, the applicator comprising a rotary crimp height adjustment plate.
Figures 2, 3, 4:
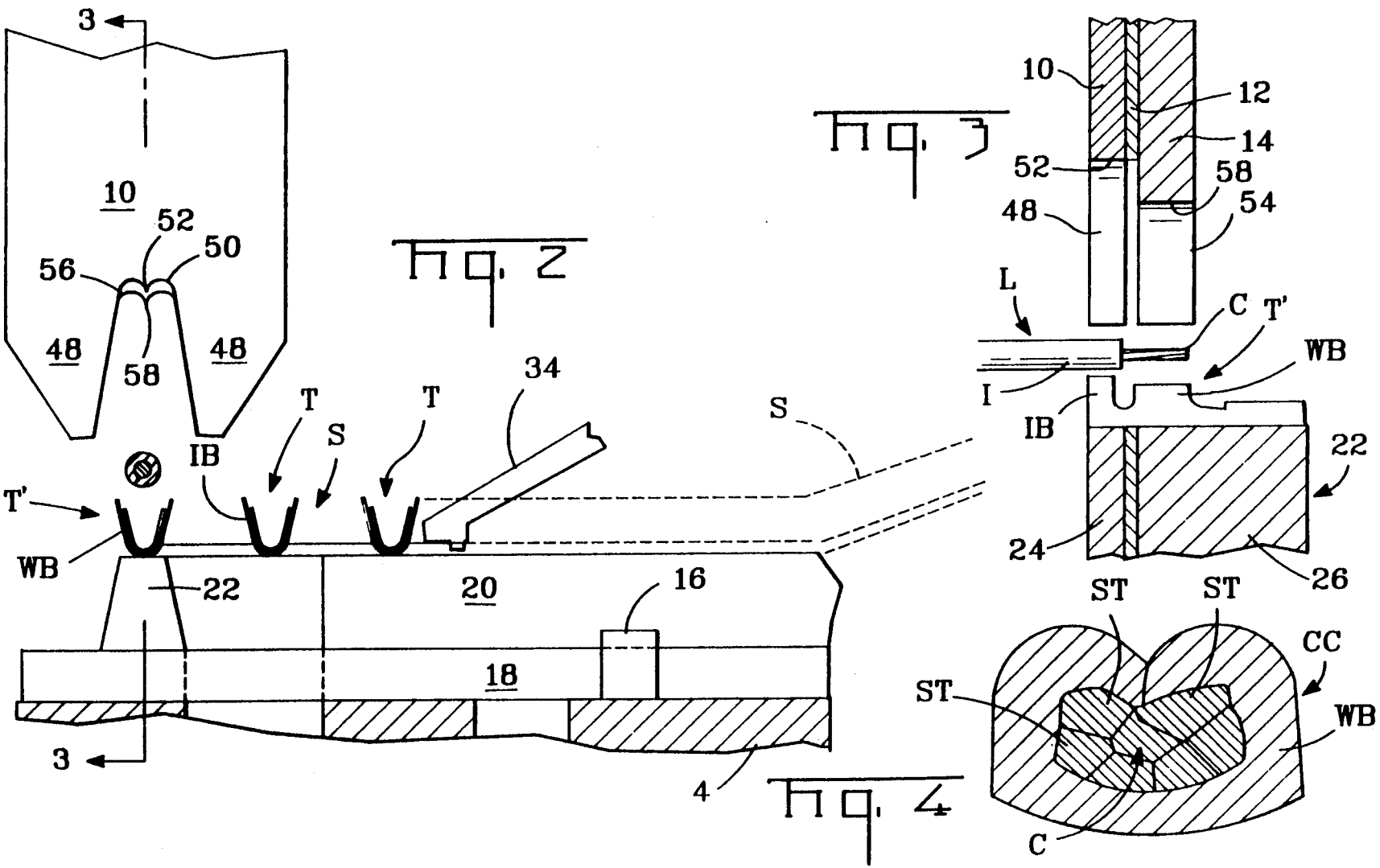
FIG. 2 is a fragmentary diagrammatic front view showing upper and lower crimping tooling of the applicator and an electrical terminal feed assembly thereof.
FIG. 3 is a view taken on the lines 3—3 of FIG. 2.
FIG. 4 is a cross-sectional view through an electrical terminal which has been crimped to an electrical lead.

As shown in FIG. 1, an electrical terminal applicator 2 comprises a frame 4 (only part of which is shown) upon which is mounted an applicator ram housing 6 in which is slidably received for vertical reciprocating motion, an applicator ram 8. There extends from the ram 8, beneath the housing 6, an insulation barrel crimping die 10 and juxtaposed therewith, with the interposition of a spacer plate 12, a wire barrel crimping die 14, as best seen in FIGS. 2 and 3. The die 10 is positioned forwardly of the die 14. A mounting plate 18 is secured to the frame 4, beneath the dies 10 and 14 by means of clips 16 (only one of which is shown). There is screwed to the plate 18, a terminal feed block 20 and a crimping anvil 22 having an insulation barrel crimping part 24 and a wire barrel crimping part 26 (FIG. 3).

As shown in FIG. 1, a terminal strip feed assembly 28 secured to the housing 6, comprises a frame 30 in which there is mounted on a pivot pin 38, a rocker arm 32 to the lower end of which is pivoted a feed finger 34 loaded by a return spring 37. The pivot pin 38 is adjustable lengthwise of the slot 40 in the plate 30 by means of a screw 42 to determine the end positions of the finger 34. The arm 32 is swung about the pin 38 by means of a slide rod 44 (by means not shown) to feed a strip S of terminals T intermittently towards the anvil 22 to locate the leading terminal T' of the strip S on the anvil 22.

Each terminal T comprises a U-section, open, insulation crimping barrel IB for crimping about the insulation I near the stripped end portion of an insulated electrical lead L, and a U-section, open, wire crimping barrel WB for crimping about the bared end of the metal core C of the lead L.

A press ram 46 is driven by an electric motor (not shown) to drive the applicator rams 8 through a downward working stroke to crimp each terminal T, which it is located on the anvil 22, to a lead L when it has been inserted between the dies 10 and 14, and the anvil 22, by means, for example, of jaws associated with a lead making machine (not shown). The ram 46 then drives the ram 8 through an upward return stroke back to its starting position. During each crimping operation, the leading terminal T' is sheared from the strip S (by means not shown).

The die 10 comprises a pair of spaced legs 48 diverging from arcuate forming surfaces 50 merging at a cusp 52, the die 14 having a pair of spaced legs 54 diverging from arcuate forming surfaces 56 merging at a cusp 58. Towards the end of the working stroke of the ram 8, the surfaces 50 of the die 10 curl over the upstanding ears of the insulation barrel IB about the insulation I of the lead L and drive them into the insulation, and the forming surfaces 56 of the die 14 curl over the upstanding ears of the wire barrel WB about the core C and wrap them over the core C to produce a cold forged crimped connection CC as shown in FIG. 4.

The insulation barrel IB when crimped to the insulation I acts as a strain relief device ensuring that if the lead L is tensioned when the lead L is in use, the core C is not broken off near the crimped connection CC, at which position the core C will have been work hardened as a result of the crimping operation. If the crimp height, that is to say, the shut height of the die 10 is too high in relation to the gauge of the insulation I, the barrel IB will grip the insulation insufficiently firmly to afford the desired strain relief. Nevertheless, if the shut height of the die 10 is too low in relation to the insulation gauge, the crimped barrel IB will extrude the insulation I and the ends of the ears of that barrel may be driven against the core C, thereby impairing its tensile strength.

If the shut height of the die 14 is too high in relation to the gauge of the core C, the strands ST of the core C will not be compressed into a voidless cold forged mass as shown in FIG. 4, so that the connection CC will be of low tensile strength. Nevertheless, if the shut height of the die 14 is too low in relation to the gauge of the core C, the strands ST may be broken off or unduly attenuated so that the connection CC is of low tensile strength in this case also.

The wire barrel WB is usually designed for crimping to cores C of a range of gauges, for example, a range of four gauges, the associated insulation barrel IB being designed for crimping to insulation of a greater range of gauges, for example, sixteen different gauges, since leads L having cores C of the same gauge may have insulation of a range of gauges, for example, a range of four gauges.

Accordingly, the shut heights of the dies 10 and 14 must be individually adjustable, where the applicator 2 is to be used with leads L of different core and insulation gauges. Especially, where the applicator 2 is incorporated in a harness making machine and is supplied with stripped leads L automatically by a lead making machine, the core and the insulation gauges of the leads may differ from each other as determined by the harness making program. In such case the shut heights of the dies 10 and 14 may need to be adjusted to the said different gauges by servo means controlled according to the program, by signals from a central computer or other programming means.

To this end, the press ram 46 is coupled to the applicator ram 8 by way of a rotary crimp height adjustment plate 60 which is formed as a single unit and which is indexable to a respective angular position by each signal, to determine simultaneously, the crimp heights for both the insulation barrel and the wire barrel.

The plate 60, which is in the form of a circular annular disc constituting a single unit comprises two superposed annular plate parts 62 and 64 respectively, of substantially equal thickness and diameter, the part 62 being for angularly adjusting the shut height of the die 10 and part 64 being for adjusting the shut height of the die 14. The parts 62 and 64 have central, circular openings in the form of bores 63 and 65 respectively, and are rigidly secured together by means of screws 66, extending through tapped through holes 68 near the edges of the parts 62 and 64, with the bores 63 and 65 in alignment. The parts 62 and 64 have peripheral recesses 70 and 72 respectively, which cooperate to define a peripheral groove receiving an annular gear wheel 74 secured to the parts 62 and 64 by means of the screws 66.

Figures 5, 6, 7, 8, 9, 10:
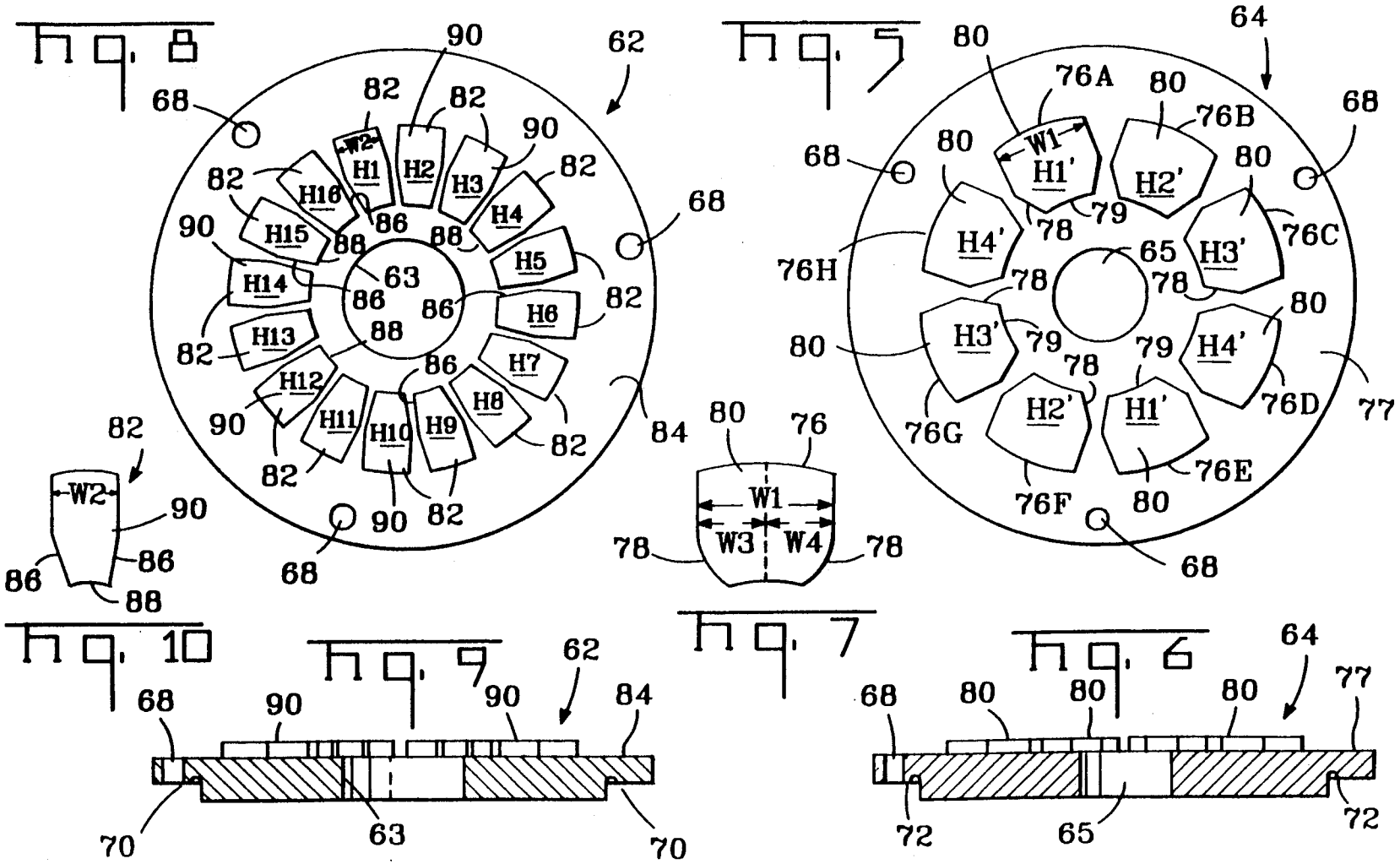
FIG. 5 is an enlarged top plan view of a first part of said adjustment plate.
FIG. 6 is an axial sectional view of the part shown in FIG. 5.
FIG. 7 is an enlarged view of a detail of FIG. 5.
FIG. 8 is an enlarged underplan view of a second part of said adjustment plate.
FIG. 9 is an axial sectional view of the part shown in FIG. 8.
FIG. 10 is an enlarged view of a detail of FIG. 8.

As best seen in FIGS. 5 to 7, the plate part 64 has a ring of eight constantly spaced, flat topped, wire crimp height adjustment projections 76A to 76G of identical dimensions standing proud of its upper major face 77, midway between the holes 68 and the bore 65 and being concentric therewith. The projections 76A to 76G are arranged in pairs of opposed projections, 76A and 76E, 76B and 76F, 76C and 76G, and 76D and 76H. For maximum projection density, the radially inner lengths of the lateral edges of these projections have chamfers 78. The radially inner ends of the projections 76A to 76H are formed with radii 79 concentric with the bore 65. Each of these projections has a flat top 80. Each projection 76A to 76H has the same maximum width, W1, about the bore 65.

The plate part 64 is supplied to the user of the applicator 2 with the flat tops 80 of all of the projections 76A to 76H extending in the same plane as shown in FIG. 6 and being thus of the same height above the major face 77. The user grinds down the flat tops 80 of each of the pairs of projections 76 to different heights, the projections of each pair being ground to the same height, these different heights corresponding to the shut heights for the die 14 that are required according to the lead making program. These different heights are indicated in FIG. 5 by H1' to H4'.

As best seen in FIGS. 8 to 10, the plate part 62 has a ring of sixteen flat topped, constantly spaced insulation crimp height adjustment projections 82 projecting from its major face 84 midway between the holes 68 and the bore 63 and being concentric therewith. For maximum projection density the inner lengths of the lateral edges of the projections 82 have chamfers 86, the radially inner ends of these projections being formed with radii 88 concentric with the bore 63. The flat tops of the projections 86 are referenced 90. All of the projections 86 have the same maximum width W2.

The plate part 62 is supplied to the user of the applicator 2 with the tops 90 of all of the projections 82 in the same plane and being thus of the same height with respect to the major surface 84 as shown in FIG. 9. The user grinds down the flat tops 90 each to a height (H2 to H16) corresponding to the shut heights for the die 10 that are required according to the harness making program. Be it noted that the maximum width W1 of each projection 76 is twice the maximum width W2 of each projection 83 and that there are four projections 82 for each projection 76. Each projection 76 is notionally divided into two half widths W3 and W4 respectively, as indicated in FIG. 7.

As shown in FIG. 1, a tool holder 92 for the die 10 is vertically slidable in the applicator ram 8 between gibs 96 on the ram 8, and has secured thereto, by means of a screw and slot adjustable connection 98, an abutment head 94 which is also slidable between the gibs 96 and which terminates in an upper abutment surface 100. There projects from a top plate 102 of the ram 8 and through the bores 63 and 65 of the adjustment plate 60, an internally tapped shaft about which the plate 60 is angularly adjustable and the screw thread of which meshes with that of an adaptor stud 106 of somewhat larger maximum diameter than the shaft 104 and which overhangs the latter. A leaf spring 108, located between the stud 106 and the shaft 104 acts between the stud 106 and the upper major face 77 of the plate 60 to urge it against the plate 102. The stud 106 is surmounted by a polygonal adaptor head 110.

A pair of opposed claws 112 and 114 depending from the press ram 46 each have an inwardly projecting flange 116 engaging beneath the adaptor head 110. Respective abutments 118 and 120 having flat lower abutment surfaces project from the undersides of the claws 112 an 114 respectively.

The angular position of the adjustment plate 60, about the shaft 104 is adjustable against the action of the spring 108 by means of an electric motor 122 secured to the frame 4 and having a rotor 124 with an output shaft 126 driving a gear wheel 74 fixed to the plate 60 and being vertically positioned by means of leaf springs 130.

The motor 122, which may be a stepping motor or a pulsed DC feed motor, is actuable by means of angular position crimp height signals which may be originated by the said switch panel or the said computer. Each signal causes the motor 122 to run for a period sufficient to cause the plate 60 to adopt one of sixteen angular positions, as determined by the harness making program and in which position predetermined projections 76 are located with their width halves W3 or W4 beneath the abutments 118 and 120 and with a predetermined projection 82 in alignment with the surface 100 of the head 94. Predetermined projections are thereby interposed between the rams 8 and 46 and between the ram 8 and the die 10, to adjust the shut heights of the dies 10 and 14 to the harness making program during its progress.

For example, when the width half W4 of the projection 76A of height H1' is under the abutment 118, the width half W4 of the projection 76E of the same height is under the abutment 120 and the projection 82 of height H12 is over the surface 100. When the width half W3 of the projection 76A is under the abutment 118 and the width half W3 of the projection 76E is under the abutment 120, the projection 82 of height H13 is over the surface 100. When the width half W4 of the projection 76A is under the abutment 120 and the width half W4 of the projection 76E is under the abutment 118, the projection 82 of height H5 is over the surface 100. When the width half of the projection 76A is under the abutment 120, and the width half W3 of the projection 76E is under the abutment 118, the projection 82 of height H6 is over the surface 100.

As will be apparent from the above examples, four insulation crimp height settings are provided for each wire crimp height setting.

We claim:

1. An electrical terminal applicator comprising an applicator ram drivable by means of a press ram through a working stroke towards, and a return stroke away from, a crimping anvil, the applicator ram having thereon a first crimping die for cooperation which the anvil to crimp a wire barrel of an electrical terminal to the bared end portion of the metal core of an insulated electrical lead during each working stroke of the applicator ram, and a second crimping die for crimping an insulation barrel of the terminal to the insulation of the lead in cooperation with the anvil during said working stroke, and being adjustable lengthwise of the applicator ram, plate means being mounted for angular adjustment about an axis on, and extending lengthwise of, the applicator ram, selectively to interpose first projections between the press ram and the applicator ram to adjust the shut height of the first die and selectively to interpose second projections between the applicator ram and the second crimping die to adjust the shut height of that die; characterized in that said plate means is in the form of a single unit, the first projections being disposed on one side thereof and the second projections being disposed on the opposite side thereof, the number of the second projections being a multiple of the number of the first projections and the maximum width of each first projection about said axis being a multiple of the maximum width of each second projection about said axis.

2. An applicator as claimed in claim 1, characterized in that the number of the second projections is four times that of the first projections, said maximum width of each first projection being twice the maximum width of each second projection.

3. An applicator as claimed in claim 1, characterized in that the first projections are arranged in pairs, the projections of each pair being disposed diametrically opposite to each other on either side of said axis, the projections of each pair being of the same height above the surface of the adjustment plate means.

4. An applicator as claimed in claim 1, characterized in that the second projections are of different heights above the surface of the adjustment plate means.

5. An applicator as claimed in claim 1, characterized in that first projections are eight in number, the second projections being sixteen in number.

6. An applicator as claimed in claim 1, characterized by an electric motor drivingly connected to said adjustment plate means and being actuable to adjust its angular position about said axis to interpose a selected second projection between the applicator rams and the second die and to interpose a selected portion of the width of each of a selected opposed pair of said first projections between said rams.

7. An applicator as claimed in claim 6, characterized in that said adjustment plate means comprises an upper plate part and a lower plate part secured together in superposed relationship, said plate parts cooperating to define a peripheral recess receiving an annular gear wheel meshing with a gear wheel driven by said motor.

8. A crimp height adjustment plate for an electrical terminal applicator, said plate comprising a central bore for receiving a shaft for mounting the adjustment plate for rotation about the axis of the shaft, a ring of flat topped first projections evenly distributed about the central bore, upon one major surface of the plate and the flat tops of the projections being of selected heights above said major surface; characterized by a ring of second flat topped projections evenly distributed about said central bore on the opposite major surface of the plate and being of selected heights above said opposite major surface; and in that the maximum width of the flat tops of each first projection, about the central bore, is a multiple of the maximum width of the flat tops of each second projection about the central bore, the number of said second projections being a multiple of the number of said first projections.

9. An adjustment plate as claimed in claim 8, characterized in that the number of the second projections is four times the number of said first projections, the maximum width of each first projection being twice the maximum width of each second projection, the first projections being arranged in pairs with the projections of each pair disposed diametrically opposite to each other on opposite sides of said central bore and the flat tops of projections of each pair being of the same height above said one major surface.

10. An adjustment plate as claimed in claim 8, characterized in that it comprises an upper plate part having said first projections and a lower plate part having said second projections, said plate parts defining a peripheral groove receiving an annular gear wheel and said plate parts being secured together in superposed relationship by fastener means, extending through the annular gear wheel.

* * * * *